United States Patent [19]

Earnest

[11] 4,066,381

[45] Jan. 3, 1978

[54] TURBINE STATOR NOZZLES

[75] Inventor: Ernest R. Earnest, Hobe Sound, Fla.

[73] Assignee: Hydragon Corporation, Lake Park, Fla.

[21] Appl. No.: 706,809

[22] Filed: July 19, 1976

[51] Int. Cl.[2] ..... F01D 9/02

[52] U.S. Cl. ..... 415/202; 415/182

[58] Field of Search ..... 415/202, 203, 205, 207, 415/211, 182, 186

[56] References Cited

U.S. PATENT DOCUMENTS

| | | | |
|---|---|---|---|
| 1,154,648 | 9/1915 | Mellin | 415/186 |
| 1,553,083 | 9/1925 | Junggren | 415/202 |
| 1,741,379 | 12/1929 | Slate | 415/186 |
| 2,526,281 | 10/1950 | Ryan et al. | 415/202 |
| 2,780,436 | 2/1957 | Holzwarth | 415/202 |
| 3,737,247 | 6/1973 | Horning | 415/205 |

*Primary Examiner*—C. J. Husar

*Attorney, Agent, or Firm*—Harness, Dickey & Pierce

[57] ABSTRACT

A radial inflow turbine with supersonic inlet nozzles in an axial-tangential plane is disclosed. The nozzles discharge into an annular vaneless space around the turbine rotor and the fluid flow enters the rotor vanes in a radially inward direction.

4 Claims, 3 Drawing Figures

FIG. 1.
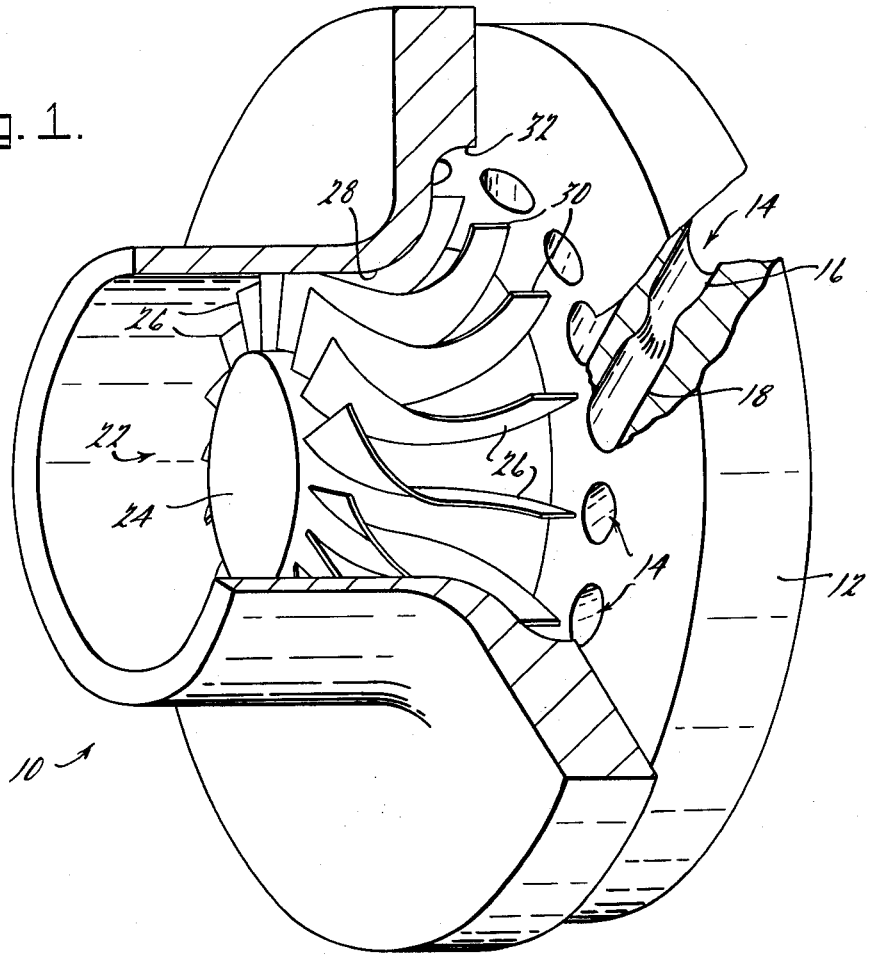
FIG. 2.
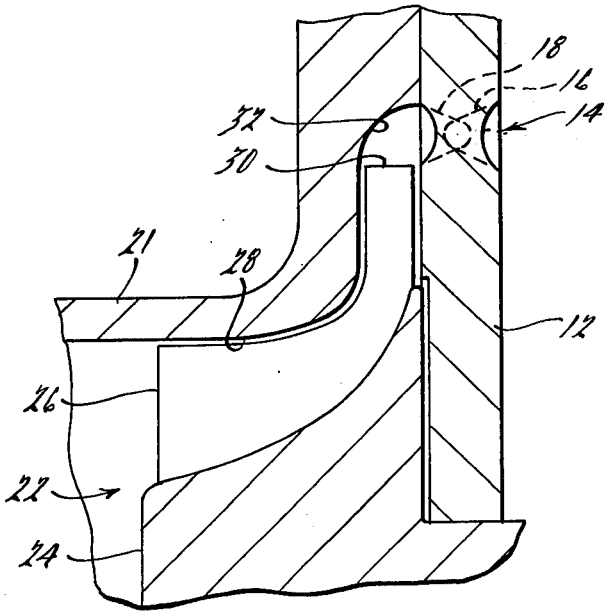
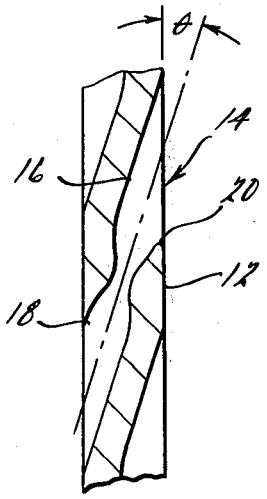
FIG. 3.

TURBINE STATOR NOZZLES

BACKGROUND-SUMMARY OF THE INVENTION

The present invention relates to improved stator nozzles and fluid flow paths for turbine engines and power plants, particularly turbines used in Rankine cycle power systems. Small scale Rankine cycle power systems typically use high pressure ratio single-stage turbines. The high pressure ratios result in supersonic flow velocities at some stage in the turbine.

Axial flow turbines for these applications often have supersonic relative flow in both the stator nozzles and rotor blading. The efficiency of these small turbines is very sensitive to the contour of flow passages, and is adversely affected by manufacturing tolerances and finishing of the wall surfaces. As a result, the nozzle passages are often of axisymmetric configuration. These passages can be satisfactorily machined by a boring operation which allows close control of contour tolerances and good surface finishing. Circular nozzle flow paths also present a lower surface area than, for example, a rectangular nozzle of the same flow area, and boundry layer flow losses are lower.

Radial inflow turbines also have been used for small scale high pressure ratio applications. Due to the radius change of the mean flow path through the rotor, the radial inflow turbine can accommodate relatively high pressure ratios without the necessity of supersonic relative rotor inlet velocities. A supersonic nozzle exit velocity is required, however.

The nozzles of radial inflow turbines direct the flow in the radial and tangential planes without any axial component. It is not possible with such turbines to bore circular cross section converging-diverging nozzles because the circumferential curvature of the exit plane does not allow sufficient tool clearance for machining the diverging portion from the discharge side. Radial inflow supersonic nozzle rings must therefore be constructed in two pieces with one shroud removable to permit machining of the passages from the side. Such nozzle passageways are usually rectangular in cross section and are subject to more difficulty than with axisymmetric bored passageways in the control of contour tolerances and the finishing of the wall surfaces.

From an efficiency standpoint, radial inflow turbines have a higher potential efficiency than axial flow turbines. At the same work level, the radial inflow turbines have a lower absolute exit velocity, a lower exhaust energy level, and thus a higher overall (total to static) potential efficiency.

The present invention has as its overall object to improve turbine engines and more particularly to improve turbines for use in high pressure ratio single-stage Rankine engines. Another object is to provide improved stator nozzles and fluid flow paths for such turbine engines. A further object is to provide a turbine which is an improvement over both axial flow turbines and radial flow turbines and which overcomes the disadvantages of each one.

Still further objects and advantages of the invention will become apparent upon consideration of the present disclosure and the accompanying drawings and claims.

BRIEF DESCRIPTION OF THE DRAWINGS

FIG. 1 is a perspective view of a turbine in accordance with the present invention;

FIG. 2 is a partial cross-sectional view of the turbine of FIG. 1; and

FIG. 3 illustrates an axial-tangential stator nozzle for use in accordance with the present invention.

DESCRIPTION OF THE PREFERRED EMBODIMENT

The basic features of the turbine are shown in FIGS. 1–3. The turbine is designated generally by the numeral 10. The heated vaporized working fluid is directed toward the turbine 10 by a suitable duct or housing (not shown). The vaporized medium strikes the stator 12 and passes through the nozzle passages 14. Each of the nozzles 14 is in an axial-tangential plane relative to the turbine 10, that is, the axis of each nozzle 14 is in a plane parallel to the axis of the turbine (FIG. 2). Within this plane it has an axial component parallel to the rotor axis and a tangential component in the direction of rotation (FIG. 3). The nozzles 14 each have a converging portion 16 and a diverging portion 18 forming a supersonic flow path for the working medium. The passages are axisymmetrical and the diverging portion 18 can be machined from the discharge side of the stator 12. The inlet of the nozzle 14 preferably has a rounded edge 20 on one side thereof to assist the flow of the vaporized fluid into and through it.

The stator 12 is positioned in a housing 21. A rotor 22 comprised of a hub 24 and a plurality of radially extending vanes 26 is centrally mounted in a cavity 28 of housing 22. The ends 30 of the vanes 26 do not extend the full length of the cavity 28, but leave an annular cavity 32 around the periphery thereof. The outlets of the nozzles 14 are in communication with the annular cavity 32 and discharge the vapor into it at supersonic velocities.

The nozzles are preferably designed with a discharge angle Θ (theta) of fifteen degrees or less. In this manner, the flow turning from the axial direction to the tangential direction is small. As the flow from one nozzle turns tangentially losing its axial velocity component, it encounters the flow from the adjacent nozzle which is also filling the vaneless space 32. The flow thus turns radially inward and enters the rotor 22. Due to the high tangential nature of the discharge from the nozzles 14, the rate of radial turning is relatively gentle and will not tend to induce high flow losses.

In accordance with the present invention, axial-tangential stator converging-diverging nozzles of axisymmetric cross-section are used in conjunction with radial inflow turbine rotors. The flow turning from the axial-tangential direction to the radial-tangential direction occurs in a vaneless annular space outboard of the turbine rotor. In addition, the stator nozzles permit boring of the nozzle passageways from the critical diverging (discharge) end.

While it is apparent that the preferred embodiment illustrated herein is well calculated to fulfill the objects above stated, it will be appreciated that the present invention is susceptible to modification, variation and change without departing from the scope of the invention, as defined by the following claims.

I claim:

1. A turbine comprising a housing, a radially inflow rotor positioned in said housing, a stator having a plurality of passages therein, each of said passages having an inlet and an outlet and forming nozzles in an axial-tangential plane relative to the axis of the turbine, said outlets of said passages opening into an annular cavity surrounding said rotor.

2. A turbine as set forth in claim 1 wherein said passages are axisymmetrical and have converging-diverging portions creating supersonic flow therethrough.

3. A turbine as set forth in claim 1 wherein the tangential angle of said passages is less than 15°.

4. A turbine for a Rankine cycle engine comprising a housing, a radially inflow rotor positioned in said housing, an annular cavity formed in said housing around the outer periphery of said rotor, and a stator adjacent said rotor and having a plurality of nozzle passageways therein, each of said passageways providing an axial-tangential flow path through the stator and having axisymmetrical converging-diverging portions therein creating supersonic flow therethrough, and each of said passageways in communication with said annular cavity whereby the working medium for said Rankine cycle engine is discharged from said passageways into said annular cavity.

* * * * *